US005806109A

United States Patent [19]

Hargaden

[11] Patent Number: 5,806,109

[45] Date of Patent: Sep. 15, 1998

[54] TOILET SEAT

[75] Inventor: James F. Hargaden, North Lauderdale, Fla.

[73] Assignee: Easy-Go, Inc., Lighthouse Point, Fla.

[21] Appl. No.: 214,013

[22] Filed: Mar. 16, 1994

Related U.S. Application Data

[63] Continuation of Ser. No. 916,957, Jul. 20, 1992, abandoned.

[51] Int. Cl.[6] ..... A47K 11/06

[52] U.S. Cl. ..... 4/483; 4/237

[58] Field of Search ..... 4/237, 239, 479, 4/483, 484, 245.5, 245.7, 452, 456, 457, DIG. 8

[56] References Cited

U.S. PATENT DOCUMENTS

| | | | |
|---|---|---|---|
| 654,301 | 7/1900 | Barnes | 4/234 |
| 2,493,362 | 1/1950 | Rocker | 4/237 |
| 3,343,179 | 9/1967 | Sellars, Jr. | 4/483 X |
| 3,422,985 | 1/1969 | Rinehart | 4/484 |
| 3,428,967 | 2/1969 | Hughes | 4/484 |
| 3,484,875 | 12/1969 | Eisenberg | 4/484 |
| 3,671,981 | 6/1972 | Smith | 4/239 X |
| 4,807,308 | 2/1989 | Person et al. | 4/483 |
| 5,170,516 | 12/1992 | Davison | 4/484 |

FOREIGN PATENT DOCUMENTS

| | | | |
|---|---|---|---|
| 0628635 | 2/1927 | France | 4/483 |
| 0005838 | 1/1909 | United Kingdom | 4/483 |
| 0018714 | 2/1914 | United Kingdom | 4/483 |
| 0238705 | 8/1925 | United Kingdom | 4/483 |

*Primary Examiner*—Robert M. Fetsuga

[57] ABSTRACT

An improved toilet seat for use in small boats not having conventional toilet facilities, with a conventional bucket for performing toilet functions, a seat being attachable to the upper rim of a bucket.

1 Claim, 1 Drawing Sheet

TOILET SEAT

This application is a continuation of application Ser. No. 07/916,957, filed Jul. 20, 1992, abandoned.

BACKGROUND OF THE INVENTION

1. Field of the Invention

This invention relates to a specially designed toilet seat that includes a lower base groove that fits snugly on a container, such as a three or five gallon bucket, the toilet seat including foam portion for flotation for additional use as a life ring in a marine or ocean environment. With the use of the improved toilet seat, a three or five gallon bucket can serve as a waste disposal container when filled with sea water or lake water.

2. Description of the Prior Art

Most small boats anywhere from 15 to 25 feet do not have a conventional "head" or toilet facility as found in much larger boats. Often, one can be in a small boat far out to sea and is forced to go to the bathroom in the water surrounding the boat. This can often be awkward for women, even if urinating, and can be embarrassing. Because of the small size of the boat, however, installing a traditional "head" is not feasible. Sometimes it is even required to come back to shore so that someone can use an available bathroom facility, interrupting the purpose of the boating outing. Most boats, however, regardless of size, include buckets that are used for various tasks of universal utility and are stored either in the boat in a front cuddy compartment or under a steering console or throttle console.

Most small boats are required to carry life jackets by the Coast Guard or life rings that can be used as flotation gear in case of an emergency if the boat sinks or capsizes or if someone falls over the side, to help save a person that is stranded in the water.

The present invention allows for an improved toilet seat that can be utilized in conjunction with a disposal container such as a conventional bucket such that the seat attaches safely and conveniently to the top rim of the bucket and conveniently disconnects when required for storage. In addition, the present improved toilet seat includes areas of increased buoyancy wherein foam is packed around portions of the bottom of the toilet seat in segmented housings defined by structure walls. This increases the buoyancy of the seat so that it can also be used alternatively as a life ring if necessary.

SUMMARY OF THE INVENTION

An improved toilet seat for attachment to a conventional bucket upper rim, said seat comprising a rigid, preferably hard plastic, circular or oval shaped body formed of an arcuate cross section joined as a ring, having a large substantially circular or elliptical opening passing therethrough, said oval body having a top surface that is arcuate throughout and shaped with an internal opening for a human being to sit thereupon and a bottom surface portion that includes a plurality of structural members both radially and circularly disposed increasing the structure of the unit pre-molded with the entire body, said bottom portion including a circular groove formed by two circular walls disposed around the bottom portion concentrically disposed around the central opening of the body portion and being sized in diameter to fit on a conventional container such as a bucket of predetermined size, such that the two parallel walls form a receiving groove that allows attachment of the seat onto the upper rim of the conventional container.

The additional chambers formed from the supporting rings or flanges and the bottom wall surface are also filled with a buoyant foam such as styrofoam, to increase the buoyancy of the seat.

The upper rigid surface of the seat may be contoured much like a conventional toilet seat, having arcuate edge portions on the outer and inner edges forming the opening where a person sits and central flat portions so that the seat is basically comfortable for a human being in a seated position. It is sufficient structurally to support the weight of a human being in a seated position for going to the bathroom into a conventional container that would be typically filled with sea water or fresh lake water from the water surrounding the boat.

The lower bottom surface may be contoured to provide a uniform thickness of the body member having indentation or compartments that may include radially disposed support members uniformly molded which join the inner and outer circular flanges that form a groove circularly that receives the upper rim of the conventional container. Typically, a three gallon or five gallon bucket is envisioned for use with the supporting groove in the bottom of the toilet seat.

Other type of connectors besides the circular supporting groove could be envisioned such as tabs at certain spaces to hold the seat in position.

Because of the unique structure of the device and the additional flotation styrofoam, it is feasible to use the device also as a life ring that could be thrown into the water with a rope attached to help someone stay afloat and retrieve them back to the boat.

To use the device for a portable emergency toilet at sea, one would place the seat itself firmly downwardly on the top of a three or five gallon bucket or other conventional circular container that will support human weight so that the supporting ridge or groove meshes and receives the upper rim of the bucket. Prior to attaching the seat, the bucket may be partially filled with water for easy disposal of the waste by throwing it over the side of the boat. Once finished, the seat may be quickly removed and stored in a convenient location. For use as a life ring, it may be stored with a rope or other device attached thereto if necessary, so that it can be thrown quickly out to a person who may fall overboard or be stranded in the water.

It is an object of the invention to provide an improved toilet seat for use with a conventional existing bucket or other type cylindrical container for emergency use at sea to allow one to go to the bathroom in a seated position.

It is another object of this invention to provide an improved toilet seat for use with small boats or in other environments where conventional toilet facilities are not available.

And yet still another object of this invention is to provide an improved toilet seat that can also function as a life ring that has buoyancy for helping support a human being in the water.

In accordance with these and other objects which will be apparent hereinafter, the instant invention will now become described with particular reference to the accompanying drawings.

PREFERRED EMBODIMENT OF THE INVENTION

Figure 1:
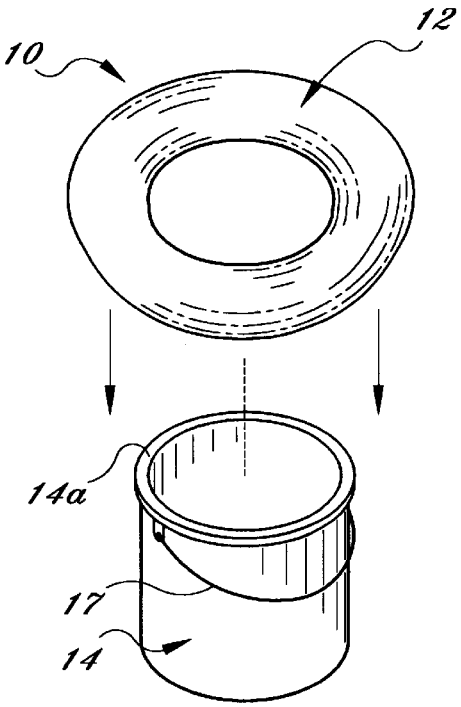
FIG. 1 shows a perspective view partially exploded of the present invention toilet seat positioned above a conventional cylindrical bucket container.

Referring now to the drawings and in particular FIG. 1, the present invention is shown generally at 10 suspended above a conventional bucket 14, the invention comprising the improved toilet seat 12. In operation, the toilet seat 12 is mounted on the upper rim 14*a* of bucket 14. The bucket 14 also includes a wire handle 17. The bucket and handle being conventional.

Figure 2:
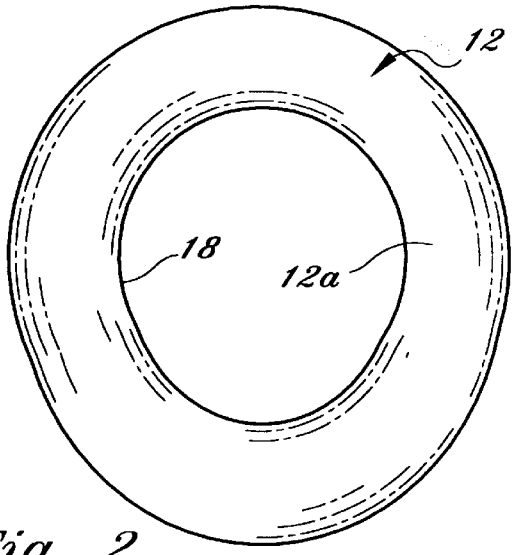
FIG. 2 shows a top plan view of the improved toilet seat in accordance with the present invention.

FIG. 2 shows a top view of the invention comprising a toilet seat 12 having an upper curved or partially curved surface 12*a* that has an inner opening defined by the lip 18 around the central portion of the device. Thus, when looking at FIG. 2 the device is substantially a circular or elliptical body having a circular or elliptical opening defined by the perimeter 18. The material is preferred to be a heavy duty plastic, but could be made of other materials suitable to support human weight when sitting on the seat. Also, the particular shape could include more elongated elliptical or other shapes both for the outer perimeter and the inside opening 18 as desired.

Figure 3:
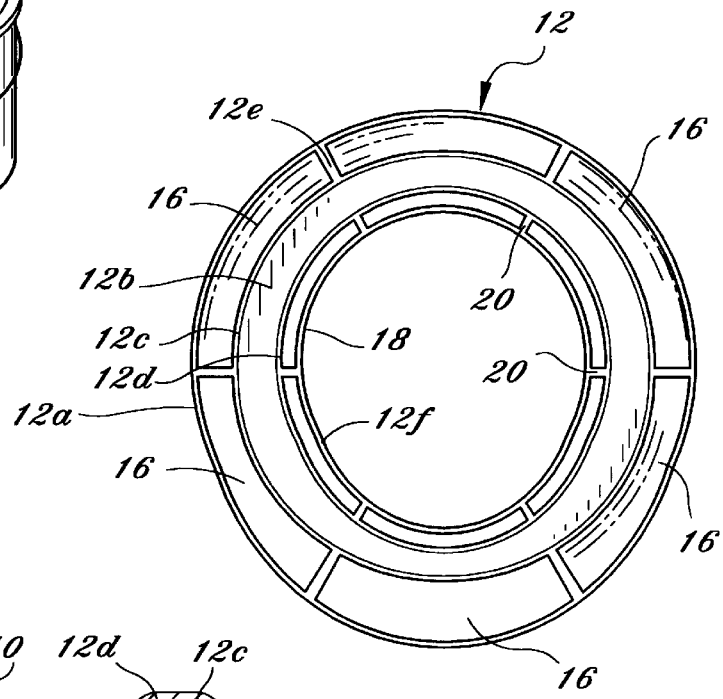
FIG. 3 shows a bottom plan view of the present invention.

Referring to FIG. 3, the bottom side of toilet seat 12 is shown. Basically, the bottom side also is a concave version of the convex side 12*a* shown in FIG. 3 with the addition of a plurality of either circumferential circular or radially disposed integrally molded support members as described further herein. The support members such as 12*e* along with the concave inner surface of the seat 12 form a plurality of compartments peripherally between the outer edge formed by 12*a* and a first inner support ring 12*c* which is substantially a circular wall that is concentrically disposed around the opening 18*a* and includes a plurality of radially disposed rigid walls 12*e*. The compartments formed between the support ring 12*c*, the support walls 12*e* and the outer thickness of the seat 12*a* are filled with foam 16 to increase the buoyancy of the seat in water so that a person can use this as a life raft. A second compartment 12*b*, which in effect is a circular groove, coaxially and concentrically disposed around the opening formed by lip 18, includes a second circular raised ring wall 12*d* spaced a predetermined distance from circular wall 12*c* so that the groove formed therein 12*b* will receive and fit snugly around the upper rim 14*a* (FIG. 1) of a conventional bucket. Thus, the circular walls 12*c* and 12*d*, defining the groove 12*b*, are raised enough (at least one-half inch or greater) to fully support the seat on top of a conventional bucket 14. This is a safety feature so that the toilet seat will not slip when a person's weight is supported while sitting on the toilet seat. Additional support walls radially, such as 20, may be included going all the way to the inner lip 18, which basically is a ring that is the thickness of the seat housing itself, approximately one-half inch in thickness throughout. If desired, additional foam could be placed in the chambers formed by radial walls 20 and ring supporting wall 12*d* and the outside lip which curves downwardly, shown as 12*f*. It is important that the circular support walls 12*c* and 12*d* have diameters that are circular to fit concentrically around the rim 14*a* of the bucket. Other than that fitting, the rim 18 can be of a predetermined shape, not necessarily circular but elliptical as in a conventional toilet seat, as is the outer ring or rim of the body shown as the outer edge of 12*a*. Typically, the outer rim 12*a* and the inner rim 12*f*, which define the thickness of the entire seat body, are the same thickness.

Figure 4:
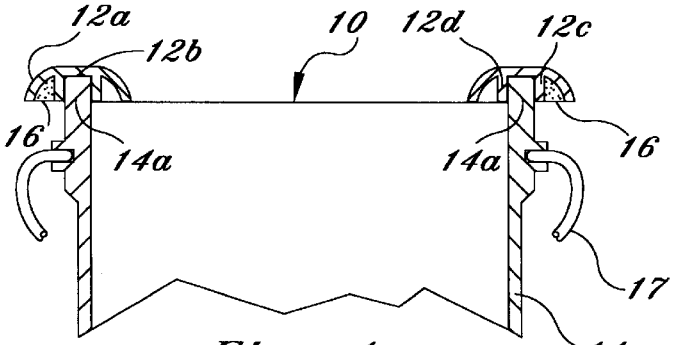
FIG. 4 shows a side elevation view in cross section showing the improved toilet seat mounted on a conventional bucket which is shown partially cut away and in cross section.

FIG. 4 shows the seat 10 mounted on bucket 14 with the groove 12*b* receiving the upper rim 14*a* of the bucket all the way around for stability so that the seat cannot slide sideways, but is firmly and snugly attached to the bucket. Foam 16 is shown on both sides which adds to the flotation of the seat.

Although the supporting groove 12*b* formed by circular support rings 12*c* and 12*d*, which are raised walls from the concave inner surface of the seat are shown, different fastening devices such as tabs could be used that are spaced appropriately around it to prevent lateral movement or sliding of the seat when it is mounted on the bucket. Additional foam can be added as discussed to ensure adequate flotation and buoyancy of the seat in the water.

Various sizes and shapes can be utilized, depending on the particular type of conventional container such as bucket 14, can be used, which include three gallon buckets, five gallon buckets or any predetermined conventional container size as desired.

In use, the toilet seat 12*a* may be stored conventionally anywhere on a boat or taken along on each boat trip. A rope could be attached thereto when not in use for emergency use as a life ring. When the seat is to be used for toilet functions, the seat is mounted on top of the conventional bucket firmly held in place so that the seat will not slide. The bucket can be partially filled with water for easy disposal of the waste when finished with use.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A portable toilet seat comprising:

a substantially annular rigid body having a partially arcuate upper surface and a concave lower surface, said body including a substantially centrally located aperture disposed therein, said body aperture having a perimeter, said body sized for receiving and supporting the weight of a human being in a seated position for use as a toilet seat;

means for mounting attached to said lower surface, said means for mounting including first and second inner support walls concentrically disposed around said body aperture perimeter, said second inner support wall spaced a predetermined distance from said first inner support wall, said first and second inner support walls defining an unobstructed receiving groove therebetween, wherein said receiving groove allows attachment of said body onto an upper rim of a bucket; and first and second sets of radial support members provided on said lower surface for strengthening said rigid body, said first set extending only from an edge of said aperture to said first inner support wall, and said second set extending only from an outer edge of said body to said second inner support wall.

* * * * *